United States Patent [19]

Tasma

[11] Patent Number: 4,546,881

[45] Date of Patent: Oct. 15, 1985

[54] TAMPERPROOF PACKAGING

[76] Inventor: Gerald W. Tasma, 3617 Colonial, NE., Grand Rapids, Mich. 49505

[21] Appl. No.: 520,024

[22] Filed: Aug. 3, 1983

[51] Int. Cl.[4] ..... B65D 85/56; B65D 81/20; B65D 33/34

[52] U.S. Cl. ..... 206/459; 206/484; 206/807; 206/497; 206/522

[58] Field of Search ..... 215/12 R, 365, 1 C; 206/457, 524.8, 807, 216, 540, 484, 459, 522, 497; 150/55

[56] References Cited

U.S. PATENT DOCUMENTS

| | | | |
|---|---|---|---|
| 2,166,513 | 7/1939 | Waters . | |
| 2,256,156 | 9/1941 | Snyder . | |
| 3,235,112 | 2/1966 | Fillwalk et al. . | |
| 3,366,226 | 1/1968 | Baklor . | |
| 3,681,092 | 8/1972 | Titchenal et al. . | |
| 3,838,600 | 10/1974 | Ersek et al. . | |
| 4,436,203 | 3/1984 | Reyner | 206/807 |
| 4,449,631 | 5/1984 | Levenberg et al. | 206/807 |
| 4,449,632 | 5/1984 | Marusiak, Jr. | 206/807 |

*Primary Examiner*—George T. Hall

*Attorney, Agent, or Firm*—Varnum, Riddering, Schmidt & Howlett

[57] ABSTRACT

A tamperproof package for containers of ingestible material such as aspirin, nonprescription drugs, food products and the like, comprising a thin layer of an elastomeric material stretched thinly over the outside surface of a container or other article such that the material will rupture and split upon being punctured. The outer edges of a sheet or opening in the elastomeric material are gathered together tightly around the container and closed by tying a string around the gathered material and/or by gluing or solvent welding. Excess material is trimmed from the gathered end. Dry lubricant is provided between the container and the elastomeric layer to facilitate movement of the elastomeric material over the surface of the container in the event of rupture of the elastomeric material. A pattern or content label can be printed onto the outside of the elastomeric layer subsequent to packaging. A method of packaging the container with an elastomeric layer includes vacuum forming of a sheet of elastomeric material in the shape of the container, inserting the container into the thus-formed sheet, gathering the free edges of the sheet, tying and/or heat-sealing the gathered end and removing the excess material from the distal end of the package.

23 Claims, 2 Drawing Figures

TAMPERPROOF PACKAGING

FIELD OF THE INVENTION

This invention relates to packages for containers of ingestible goods where any attempt to tamper with the contents will be readily visible to the consuming public

STATE OF THE PRIOR ART

There is currently a great interest in tamperproof packages, that is packages in which any attempt to tamper with the contents will be readily visible and apparent to the consuming public. This type of packaging is needed not only to inform the consuming public if the contents of a container has been altered but also to build confidence in the consuming public of the safety of a product which it buys. Many tamperproof packages have been proposed to meet this need. Whereas many of these packages may be effective for preventing tampering without a clear indication, the consuming public often does not know whether the package has been tampered with. Also, many packages do not detect contamination with a needle.

Examples of tamperproof packaging which have been suggested long ago are illustrated in the Snyder U.S. Pat. No. 2,256,156 (issued Sept. 16, 1941) and to Waters U.S. Pat. No. 2,166,513 (issued July 18, 1939). Both of these packages use a rubber hydrochloride film to encapsulate a bottle or other container. In Waters, a special film material is used so that the packaging with the same film material would be very difficult. The problem with this theory is that the consumer could not tell whether the goods have been repackaged unless he or she has special knowledge of the particular material used. The Snyder package provides for heat-sealing of the rubber hydrochloride film around the bottle or container with some heat-shrinking to conform to the shape of the bottle. However, this packaging is relatively unsophisticated and could be duplicated with relatively unsophisticated techniques. Neither of the packages proposed would expose penetration by a needle into the container.

SUMMARY OF THE INVENTION

According to the invention, a tamperproof package encapsulating an article comprises a thin layer of elastomeric material stretched thinly over the outside surface of the article, the layer of elastomeric material having at least one portion with an opening which has been gathered together and tightly closed. The elastomeric layer is stretched to the elastomeric limit of the material such that the elastomeric layer will rupture and split if penetrated by a sharp object. The elastomeric layer can have printing in either a regular pattern or with the contents of the container.

Preferably, a dry lubricant, such as talc powder, is provided between the article and the layer of elastomeric material to facilitate sliding of the elastomeric layer over the article in the event of rupture of the material. If desirable, a slight air pressure can be provided within the elastomeric layer to further assist in the separation process in the event of tampering.

The invention is especially applicable to bottles containing oral medication, such as aspirin, but is also applicable to food products.

Preferably, the end of the elastomeric layer is tied tightly with a flexible filament such as string. Alternatively, or in addition to the tying, the end of the elastomeric layer can be glued or solvent welded.

Further according to the invention, there is provided a method of packaging a container having medication therein comprising the steps of stretching a thin elastomeric film over the container to the elastomeric limit of the film, gathering end portions of the film tightly and closing the gathered end portions of the film to form a substantially impermeable, airtight layer about the container. Excess material is separated from the package close to the closed, gathered end portion of the film. In a preferred embodiment of the invention, the film is stretched over the container by shaping the film to generally conform with the shape of the container and slightly larger thereof and thereafter inserting the container into the shaped film. A preferred way of shaping the film is by drawing a vacuum on the sheet of film. The closed sheet of film can be tied, glued or solvent welded. Further, the invention contemplates first applying a dry lubricant to the elastomeric film prior to the inserting step so that the dry lubricant will be positioned between the article and the film. Preferably, printing is provided on the outside surface of the film subsequent to the closing step. The printing step can include printing a pattern and/or a label onto the film.

BRIEF DESCRIPTION OF THE DRAWINGS

The invention will now be described with reference to the accompanying drawings in which.

DETAILED DESCRIPTION OF THE PREFERRED EMBODIMENT

Figure 1:
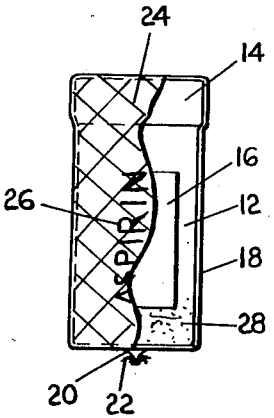
FIG. 1 is a view of a bottle with a tamperproof package according to the invention.

Referring now to the drawings, and to FIG. 1 in particular, there is shown a bottle 12 having a cap 14 and a label 16. The bottle may contain medication such as aspirin. A tamperproof package is provided for the bottle 12, the packaging comprising a skin-tight, very thin, elastomeric encapsulation layer 18 having a gathered end 20 tied securely together with a tie 22. The gathered end 20 of the encapsulation 18 is preferably tied but can be heat-sealed if desired. The elastomeric encapsulation layer 18 may have a patterned marking 24 on the surface thereof and may also have a label 26 printed on the surface. A dry lubricant 28 such as talc powder is present between the bottle 12 and the elastomeric encapsulation layer 18. A slight air pressure can be provided in the encapsulation layer 18 between the bottle 12 and the elastomeric layer 18.

The elastomeric encapsulation layer 18 can be any suitable elastomeric material which can be made in a thin sheet and stretched very thin and tightly over the outside surface of the bottle. The elastomeric materials are generally rubbers, that is, materials which have a very high degree of elasticity or memory in film form. Typically, these materials have very high elongation characteristics, e.g. 200%–800% in the elastic range but very little or no elongation in the plastic range, i.e. when the elastic limit has been exceeded. The important characteristic of this material is that it can be formed into a highly elastic thin film which will split and separate very quickly upon rupture or penetration when the film is stretched to or near its elastic limit. Typically, these materials are thermosetting materials which can be joined by glueing or solvent welding. Examples of suitable materials include natural and synthetic rubbers such as butadiene-styrene polymers, butadiene-acrylonitrite copolymers, neoprene, isobutylene-diolefin copolymers, polysulfide and siloxane polymers. Such materials have been made into films for balloons and surgical gloves. A suitable material includes surgical rubber of the type which is used in surgical gloves. The elastomeric material should be substantially impermeable to air flow and water.

The patterned marking 24 is preferably printed on the elastomeric encapsulation subsequent to packaging so that there are substantially no distortions in the marking. Similarly, the label 26 can also be printed on the encapsulaion subsequent to the packaging.

The elastomeric encapsulation 18 is stretched so thin and to the elastic limit of the material so that if the layer is penetrated by a needle or other sharp object, it will immediately burst or split like a balloon. The dry lubricant 28 provides lubrication to allow the layer 18 to readily slide over the surface in the event of puncture. Thus, if one attempts to tamper with the package by inserting a needle through the packaging container, the elastomeric encapsulation will split and rupture like a balloon, thereby giving immediate visual indication that the package has been tampered with.

The elastomeric encapsulation 18 is tied tightly with the tie 22 so that it cannot be removed without destroying the encapsulation layer 18. Further, there is little or no excess material outside of the tie 22 so that if the tie 22 is removed, the encapsulation material cannot then again be stretched over the container and retied. In short, the encapsulation 18 provides a balloon-type package which is stretched so thin that any tampering will result in rupture of the elastomeric encapsulation layer or, in the event that it is removed without rupture, will be so small as to preclude repackaging.

Further, pattern marking 24 and the label 26 are such that any attempt to reuse the elastomeric encapsulation material will result in distortions of the pattern, thereby giving a further visual indication of tampering.

Figure 2:
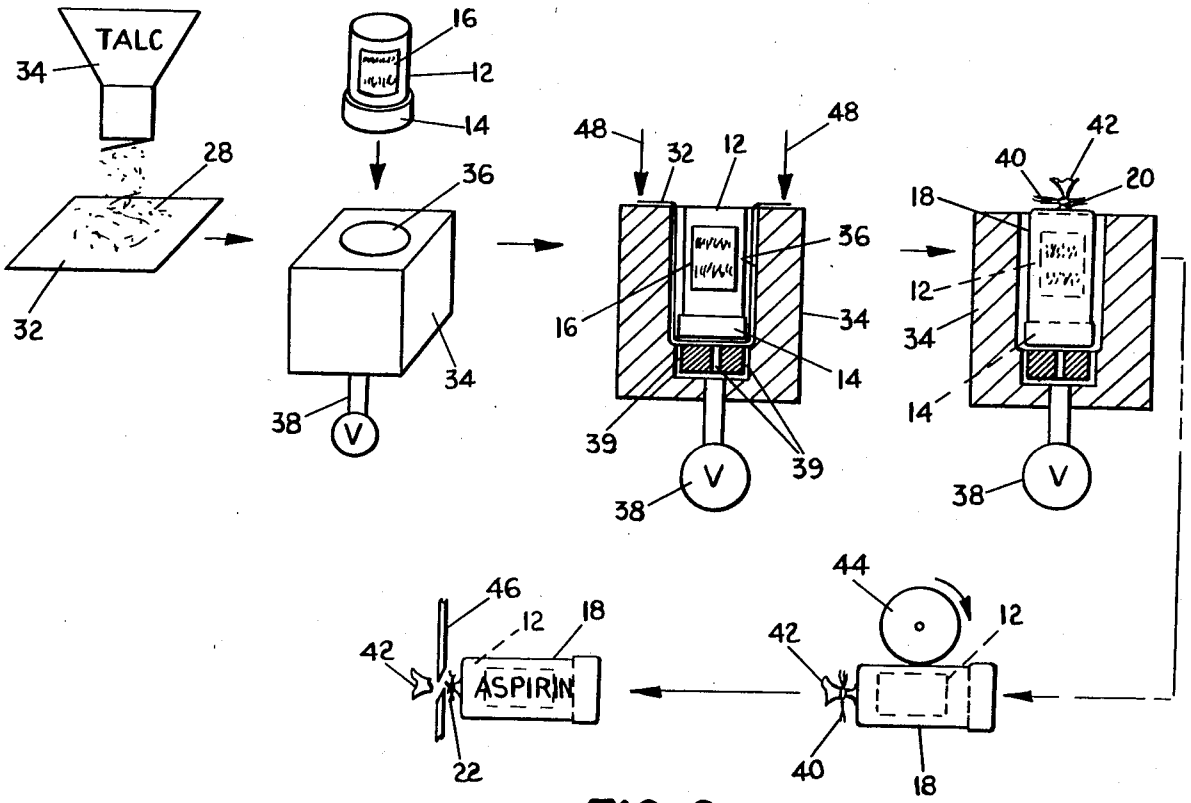
FIG. 2 is a schematic flow diagram illustrating a method of encapsulating a bottle with a tamperproof package according to the invention.

Reference is now made to FIG. 2 for a description of a process for encapsulating a bottle with a thin, elastomeric layer. Talc or other dry lubricant 28 is dispensed from a conventional dispenser 34 onto a thin sheet 32 of elastomeric material. The sheet, thus lightly coated with a dry lubricant, is positioned over a vacuum mold 32 having a cylindrical cavity 36. A vacuum source 38 communicates with the cylindrical cavity 36 to draw a vacuum therein. The elastomeric sheet 32, thus positioned over the top of the cavity 36, is stretched and drawn down into the cavity by the vacuum source thereby forming a cylindrical shape in the sheet. Portions of the sheet 32 extend over the top edge of the mold 34. Clamps 48 hold the free edges of the sheet during the vacuum forming step. Vacuum ports 39 provide communication between the cylindrical cavity 36 and the vacuum source 38. The bottle 12 is positioned within the cylindrical shape of the elastomeric sheet 32 and the outer portions of the sheet 32 are gathered tightly around the bottom end of the bottle 12 (which is upside down in the cavity 36). A string 40 is tied tightly around the elastomeric sheet at the bottom end of the bottle 12 to tightly encapsulate the bottle within the thinly stretched elastomeric sheet. Air can be introduced between the bottle and the elastomeric sheet during this process by virtue of the difference between the diameter of the bottle and the diameter of the mold cavity 36. External means, such as a thin nozzle (not shown), can also be used to inject air through the opening in the gathered elastomeric layer 32 during the tying process and the means can be removed subsequent to or during the tying operation. As illustrated in FIG. 2, the tying of the string 40 around the outside of the elastomeric sheet results in excess material 42.

The bottle, thus encapsulated, is then passed through a printing operation in which a printing wheel 44, for example, prints the label, and/or a regular pattern onto the surface of the elastomeric encapsulation 18. Subsequent to the printing operation, the excess material 42 can be severed closely adjacent to the tie 40 by knife blades 46. The excess string material 40 can also be trimmed.

The invention has been described with reference to vacuum-forming of a sheet of thermoplastic film. However, the elastomeric film can be first molded in the general shape of the article and stretched over the article by pulling.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. An article with a tamperproof package encapsulating the same, the tamperproof package comprising:

a thin layer of an elastomeric material stretched thinly over the outside surface of the article, the layer of elastomeric material having at least one portion with an opening the edges of which have been gathered together and closed tightly;

the elastomeric layer being stretched to the elastic limit of the material such that the elastomeric layer will rupture and split if penetrated by a sharp object; and a lubricant between the article and the layer of elastomeric material to facilitate sliding of the elastomeric layer over the article in the event of rupture of the elastomeric layer.

2. An article with a tamperproof package according to claim 1 and further comprising printing on the surface of the elastomeric layer.

3. An article with a tamperproof package according to claim 2 wherein the printing comprises a regular pattern.

4. An article with a tamperproof package according to claim 3 and further comprising a slight air pressure within the elastomeric layer.

5. An article with a tamperproof package according to claim 4 wherein the article is a bottle containing human ingestible material.

6. An article with a tamperproof package according to claim 5 wherein the end of the elastomeric layer is tied tightly with a flexible filament.

7. An article with a tamperproof package according to claim 6 wherein there is substantially no excess material outside the string distal to the article.

8. An article with a tamperproof package according to claim 4 wherein the edges in the thin layer are glued or solvent welded together.

9. An article with a tamperproof package according to claim 4 wherein the end of the elastomeric layer is tightly tied with a flexible filament and there is substantially no excess material outside the string distal to the article.

10. An article with a tamperproof package according to claim 1 wherein the article is a bottle containing human ingestible material.

11. An article with a tamperproof package according to claim 1 wherein the end of the elastomeric layer is tied tightly with a flexible filament and there is substantially no excess material outside the string distal to the article.

12. An article with a tamperproof package according to claim 2 wherein the article is a bottle containing human ingestible material.

13. An article with a tamperproof package according to claim 2 and further comprising a slight air pressure within said elastomeric layer.

14. An article with a tamperproof package according to claim 2 wherein the end of the elastomeric layer is tied tightly with a flexible filament and there is substantially no excess material outside the string distal to the article.

15. An article with a tamperproof package according to claim 1 and further comprising a slight air pressure within said elastomeric layer.

16. An article with a tamperproof package according to claim 1 and further comprising a dry lubricant between the article and the layer of elastomeric material to facilitate sliding of the elastomeric layer over the article.

17. An article with a tamperproof package according to claim 1 wherein the article is a bottle containing human ingestible material.

18. An article with a tamperproof package according to claim 1 wherein the end of the elastomeric layer is tied tightly with a flexible filament and there is substantially no excess material outside the string distal to the article.

19. An article with a tamperproof package according to claim 1 wherein the opening in the thin layer is glued or solvent welded.

20. An article with a tamperproof package according to claim 2 wherein the lubricant between the article and the layer of elastomeric material is dry.

21. An article with a tamperproof package according to claim 20 wherein the dry lubricant consists of talc powder.

22. An article with a tamperproof package according to claim 1 wherein the lubricant between the article and the layer of elastomeric material is dry.

23. An article with a tamperproof package according to claim 22 wherein the dry lubricant consists of talc powder.

* * * * *

UNITED STATES PATENT AND TRADEMARK OFFICE

CERTIFICATE OF CORRECTION

PATENT NO. : 4,546,881

DATED : October 15, 1985

INVENTOR(S) : GERALD W. TASMA

It is certified that error appears in the above-identified patent and that said Letters Patent are hereby corrected as shown below:

Column 5, line 2, "claim 1" should read --claim 4--.

Column 5, line 5, "claim 1" should read --claim 4--.

Signed and Sealed this

*Twenty-seventh* Day of *May 1986*

[SEAL]

*Attest:*

DONALD J. QUIGG

*Attesting Officer*

*Commissioner of Patents and Trademarks*